US012637261B2

(12) United States Patent
Wang et al.

(10) Patent No.: US 12,637,261 B2
(45) Date of Patent: May 26, 2026

(54) LEAK-PROOF STRAW CUP

(71) Applicant: Zhejiang Ansheng Science & Technology Stock Co., Ltd., Yongkang (CN)

(72) Inventors: Haofeng Wang, Jinhua (CN); Xiaohui Tang, Jinhua (CN); Haiyang Wu, Jinhua (CN); Jing Sun, Jinhua (CN)

(73) Assignee: Zhejiang Ansheng Science & Technology Stock Co., Ltd., Yongkang (CN)

( * ) Notice: Subject to any disclaimer, the term of this patent is extended or adjusted under 35 U.S.C. 154(b) by 126 days.

(21) Appl. No.: 18/650,495

(22) Filed: Apr. 30, 2024

(65) Prior Publication Data

US 2025/0304335 A1 Oct. 2, 2025

(30) Foreign Application Priority Data

Mar. 28, 2024 (CN) ..... 202420627618.X
Mar. 28, 2024 (CN) ..... 202420627918.8

(51) Int. Cl.

| | |
|---|---|
| ***B65D 47/06*** | (2006.01) |
| ***A47G 19/22*** | (2006.01) |
| ***B65D 25/28*** | (2006.01) |
| ***B65D 43/02*** | (2006.01) |
| ***B65D 47/20*** | (2006.01) |
| ***B65D 47/32*** | (2006.01) |
| ***B65D 53/02*** | (2006.01) |

(52) U.S. Cl.

CPC ..... *B65D 47/06* (2013.01); *A47G 19/2222* (2013.01); *A47G 19/2272* (2013.01); *B65D 25/2811* (2013.01); *B65D 43/0229* (2013.01); *B65D 47/20* (2013.01); *B65D 47/32* (2013.01); *B65D 53/02* (2013.01); *B65D 2205/02* (2013.01); *B65D 2313/04* (2013.01); *B65D 2543/00046* (2013.01); *B65D 2543/00092* (2013.01); *B65D 2543/00509* (2013.01); *B65D 2543/00972* (2013.01)

(58) Field of Classification Search

CPC ..... B65D 2525/281; B65D 25/2811; B65D 2525/288; B65D 47/20; B65D 47/2012; B65D 47/244; B65D 47/242

USPC ..... 220/708, 709, 710, 756; 215/391; 16/111.1

See application file for complete search history.

(56) References Cited

U.S. PATENT DOCUMENTS

| | | | | |
|---|---|---|---|---|
| 7,657,971 | B2 * | 2/2010 | Danko | E05D 1/06 220/230 |
| 11,712,124 | B2 * | 8/2023 | Bullock | B65D 47/32 220/709 |
| 2025/0033854 | A1 * | 1/2025 | Jacob | B65D 77/286 |
| 2025/0197065 | A1 * | 6/2025 | Beardsell | B65D 47/26 |

* cited by examiner

*Primary Examiner* — Jeffrey R Allen

(57) ABSTRACT

The application discloses a leak-proof straw cup and relates to the field of cups. The leak-proof straw cup comprises a receiving portion for receiving liquid; a sealing portion detachably connected to the receiving portion and used for sealing the receiving portion; a circulation hole formed in the sealing portion and connecting two sides of the sealing portion; a first water outlet portion connected to the circulation hole and detachably connected to the sealing portion; and a storage portion fixed to a side wall of the receiving portion and used for storing the first water outlet portion. The leak-proof straw cup can store a straw easily.

15 Claims, 6 Drawing Sheets

A

LEAK-PROOF STRAW CUP

CROSS REFERENCE TO RELATED APPLICATIONS

The present application claims the benefit of Chinese Patent Application Nos. 202420627618X and 2024206279188 filed on Mar. 28, 2024. All the above are hereby incorporated by reference in their entirety.

BACKGROUND OF THE INVENTION

1. Technical Field

The application relates to the field of cups, in particular to a leak-proof straw cup.

2. Description of Related Art

Straw cups on the present market comprise a cup body and a straw arranged in the cup body, one end of the straw extends to the bottom of the cup, and an opening in the lower end of the straw is bevel.

In the implementation process of the above application, the inventor finds that this technique has at least the following problems: the straw cannot be stored easily, is likely to be polluted by dust due to long-term exposure to the air, and is inconvenient to carry.

BRIEF SUMMARY OF THE INVENTION

The application provides a leak-proof straw cup which is easy to carry and store, thus reducing the possibility of dust pollution of a straw.

The application provides a leak-proof straw cup, which adopts the following technical solution:

A leak-proof straw cup comprises a receiving portion for receiving liquid; a first water outlet portion arranged in the receiving portion and used for transferring the liquid; and a storage portion fixed to a side wall of the receiving portion and used for storing the first water outlet portion.

By adopting the above technical solution, the first water outlet portion is arranged in the receiving portion, and the storage portion is fixed to the side wall of the receiving portion, such that the receiving portion and the first water outlet portion can be driven to move synchronously in use, the first water outlet portion can be taken out when needed and can also be stored easily; and the first water outlet portion is arranged in the receiving portion, thus being less likely to be polluted by dust.

Optionally, the leak-proof straw cup further comprises a sealing portion detachably connected to the receiving portion and used for sealing the receiving portion (1); and a circulation hole formed in the sealing portion and connecting two sides of the sealing portion.

By adopting the above technical solution, the sealing portion seals an opening of the receiving portion, thus guaranteeing the cleanliness of the inside of the receiving portion.

Optionally, the storage portion is curved, and a gap is formed between a side wall of the storage portion and an outer side wall of the receiving portion.

By adopting the above technical solution, the gap is formed between the side wall of the storage portion and the outer side wall of the receiving portion, and when the receiving portion is controlled to move, users can stretch their hands in the gap to drive the storage portion to move so as to drive the receiving portion to move, such that operation is easy.

Optionally, a storage groove is formed in the storage portion and used for receiving the first water outlet portion, an anti-disengagement portion is arranged on the storage portion, one end of the anti-disengagement portion is rotatably arranged on the storage portion, and the other end of the anti-disengagement portion is arranged at an end of the storage groove and seals the storage groove.

By adopting the above technical solution, the first water outlet portion can be placed in the storage groove and be fixed in the storage groove to be stored by rotating the anti-disengagement portion.

Optionally, a first magnet is fixed in the storage portion, a second magnet is fixed in the anti-disengagement portion, and the first magnet and the second magnet are mutually attracted to fix positions of the anti-disengagement portion and the storage portion.

By adopting the above technical solution, the first magnet and the second magnet can be mutually attracted to fix the positions of the anti-disengagement portion and the storage portion, thus reducing the possibility of automatic rotation of the anti-disengagement portion.

Optionally, a connecting portion is fixed to a bottom of the sealing portion and connected to the circulation hole, and the first water outlet portion penetrates through the connecting portion.

By adopting the above technical solution, the first water outlet portion penetrates through the connecting portion, the connecting portion has a connecting function, different components can be connected to the bottom of the connecting portion, and the connecting portion also has a limiting function to keep the first water outlet portion vertical to allow users to drink water smoothly.

Optionally, a second water outlet portion is detachably connected to a bottom of the connecting portion and extends to a bottom of an inner side of the receiving portion.

By adopting the above technical solution, the second water outlet portion extends to the bottom of the inner side of the receiving portion and sucks water from the bottom of the inner side of the receiving portion during the drinking process, such that users can drink water smoothly.

Optionally, a positioning portion is detachably connected to the bottom of the connecting portion and penetrates into the connecting portion, a positioning ring is fixed to an outer wall of the positioning portion and abuts against an end of the connecting portion, and the second water outlet portion penetrates through the positioning portion and is connected to an inside of the connecting portion.

By adopting the above technical solution, the positioning portion has a connecting function, during the installation process, the second water outlet portion penetrates into the positioning portion, and then the positioning portion penetrates into the connecting portion, such that the second water outlet portion and the connecting portion are connected; and the size of an opening in the positioning portion can be adjusted to adapt to the second water outlet portion with different diameters, thus facilitating the installation of the second water outlet portion.

Optionally, a blocking portion is fixed in the connecting portion and has an end face protruding towards the sealing portion, a plurality of water holes are formed in the blocking portion, and a first sealing portion for sealing the water holes is slidably arranged in the connecting portion.

By adopting the above technical solution, the first sealing portion can be controlled to move in the connecting portion to enable the first sealing portion to come in contact with or be separated from the blocking portion so as to control the water holes to be closed or opened, and the control operation is easy.

Optionally, a plurality of second sealing portions are fixed to an outer wall of the first sealing portion and abut against an inner wall of the connecting portion.

By adopting the above technical solution, the second sealing portions abut against the inside of the connecting portion, thus further improving the sealing effect of the first sealing portion.

Optionally, a control portion is fixed to the sealing portion and partially extends into the circulation hole, the control portion is hollow, a driving portion is arranged in the control portion, the first sealing portion is circular and disposed around an end of the driving portion, and the first water outlet portion penetrates into the driving portion and is connected to a second water outlet portion.

By adopting the above technical solution, the driving portion can be controlled to move to drive the first sealing portion to move so as to control the water holes to be opened or closed.

Optionally, a stop block is fixed to a side wall of the driving portion, a stop groove allowing the stop block to penetrate therein is formed in a side wall of the control portion, the stop groove is oblique, and the driving portion is rotatable to drive the stop block to move in the stop groove to adjust a position of the first sealing portion to control the water holes to be opened or closed.

By adopting the above technical solution, the stop groove is oblique, and the driving portion can be rotated to drive the stop block to move in the stop groove to adjust the position of the first sealing portion so as to control the water holes to be opened or closed.

By adopting the above technical solution, a mounting groove is formed in the control portion and extends to a top of the control portion, the mounting groove is connected to the stop groove, and a stop protrusion is fixed to an inner side wall of the stop groove and used for preventing the stop block from moving into the mounting groove.

By adopting the above technical solution, when needing to be removed, the driving portion is rotated until the stop block corresponds to the mounting groove in position, and at this moment, the driving portion can be taken out; and the stop protrusion has a limiting function, thus reducing the possibility that the stop block rotates to the mounting groove in the absence of an external force.

Optionally, a control button is fixed to a top of the driving portion, an opening is formed in a middle of the control button and connected to an inside of the driving portion, and the first water outlet portion penetrates into the opening in the middle of the control button and is in interference fit with the opening.

By adopting the above technical solution, the control button can be rotated to drive the driving portion to rotate, and the control button is arranged outside the circulation hole, such that the operation process is simple.

Optionally, an air hole is formed in the sealing portion.

By adopting the above technical solution, after the first water outlet portion is connected to the sealing portion, the air hole can facilitate air circulation in the receiving portion to allow users to drink water smoothly.

Optionally, a second drinking hole is formed in the sealing portion, and a sealing cover for sealing the second drinking hole is rotatably arranged on the sealing portion.

By adopting the above technical solution, the second drinking hole can also be used for drinking and can be controlled to be opened or closed by rotating the sealing cover.

Optionally, a positioning rib is fixed to the sealing cover, and a positioning groove allowing the positioning rib to penetrate therein is formed in the sealing portion.

By adopting the above technical solution, the positioning rib can penetrate into the positioning groove to fix the position of the sealing cover.

Optionally, a limiting block is fixed to the sealing portion, and a positioning block is fixed to a rotating shaft of the sealing cover.

By adopting the above technical solution, the limiting block is used for limiting the position of the sealing cover, and the sealing cover can be rotated to allow its end face to abut against the limiting block, such that the position of the sealing cover is limited; and the positioning block also has a limiting function, and when the end face of the sealing cover abuts against the limiting block, the positioning block abuts against the sealing portion to fix the position of the sealing cover.

Optionally, a sealing ring is fixed to a side wall of the sealing portion and used for improving leak-proofness between the sealing portion and the receiving portion.

By adopting the above technical solution, the sealing ring is used for improving the leak-proofness between the sealing portion and the receiving portion, thus guaranteeing the leak-proofness of the receiving portion.

Optionally, the storage portion is a cup handle.

By adopting the above technical solution, the storage portion is a cup handle, and a straw can be placed in the cup handle to be carried easily.

To sum up, the application has at least one of the following beneficial technical effects:

1. The first water outlet portion is arranged in the receiving portion, and the storage portion is fixed to the side wall of the receiving portion, such that the receiving portion and the first water outlet portion can be driven to move synchronously in use, the first water outlet portion can be taken out when needed and can also be stored easily; the first water outlet portion is arranged in the receiving portion, thus being less likely to be polluted by dust;
2. The second drinking hole can also be used for drinking and can be controlled to be opened or closed by rotating the sealing cover, thus realizing a dual-drinking effect; under the condition of guaranteeing the dual-drinking effect, the straw cup also has good leak-proofness and will not leak water when placed laterally or falling; compared with dual-drinking cups, which have poor leak-proofness and cannot be completely sealed, on the present market, the leaf-proofness of the leaf-proof straw cup is greatly improved, and the leaf-proof straw cup is easy to carry;
3. The second water outlet portion is detachably connected to the connecting portion, such that the connecting portion and the second water outlet portion can be cleaned easily, the problem that the connecting portion or the second water outlet portion is difficult to clean when become dirty after long-term use is solved, the cleanliness in use is effectively guaranteed, and sanitation problems are reduced.

REFERENCE SIGNS

1, receiving portion; 2, sealing portion; 3, circulation hole; 4, first water outlet portion; 5, storage portion; 6, storage groove; 7, anti-disengagement portion; 8, first magnet; 9, second magnet; 10, connecting portion; 12, second water outlet portion; 13, positioning portion; 14, positioning ring; 15, blocking portion; 16, water hole; 17, first sealing portion; 18, second sealing portion; 19, control portion; 20, driving portion; 21, stop block; 22, stop groove; 23, mounting groove; 25, stop protrusion; 26, control button; 27, air hole; 28, second drinking hole; 29, sealing cover; 30, positioning rib; 31, positioning groove; 32, limiting block; 33, positioning block; 34, mounting guide surface; 35, sealing ring.

DETAILED DESCRIPTION OF THE INVENTION

The application is described in further detail below in conjunction with FIG. 1-FIG. 6.

Embodiment 1

Figure 1:
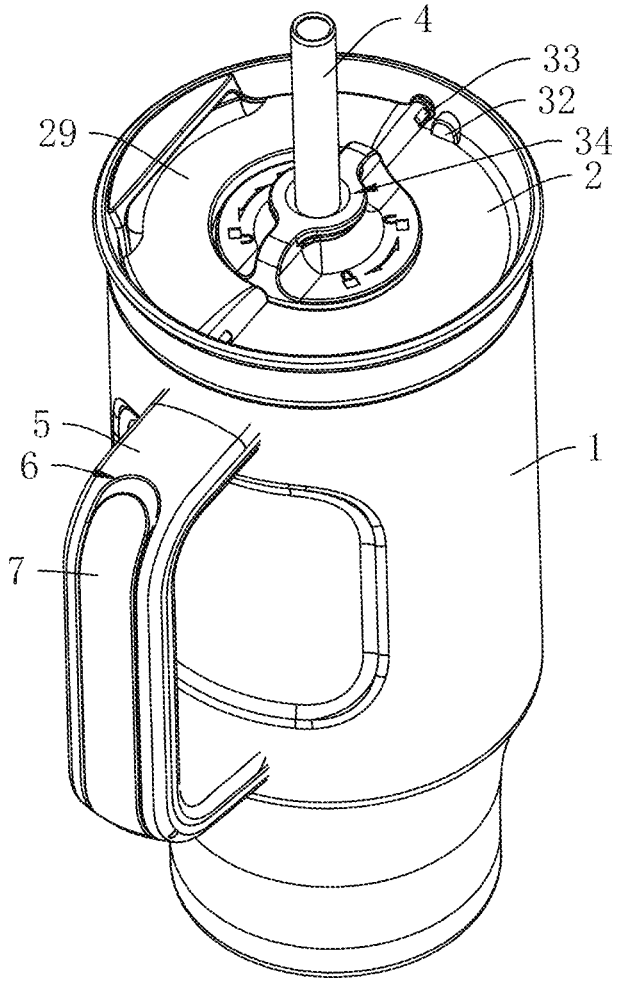
FIG. 1 is a schematic diagram of a main structure according to Embodiment 1 of the application.
Figure 2:
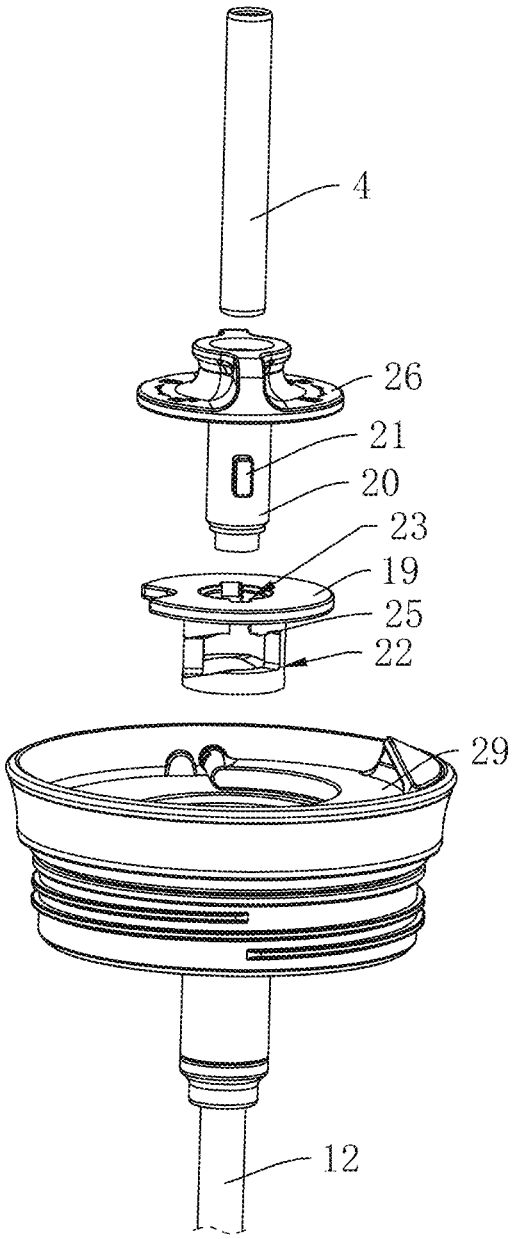
FIG. 2 is an exploded view of the connection of a control portion according to Embodiment 1 of the application.
Figure 3:
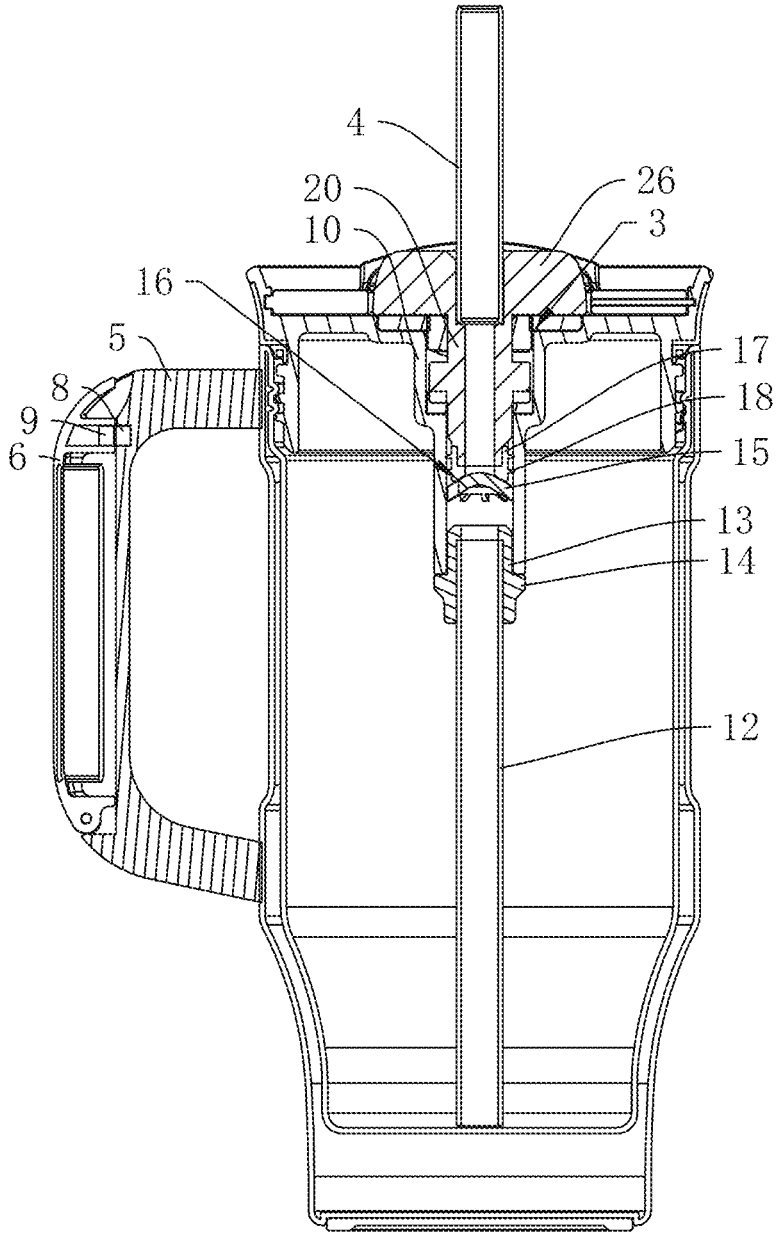
FIG. 3 is a sectional view of the position of a blocking portion according to Embodiment 1 of the application.

This embodiment of the application discloses a leak-proof straw cup. Referring to FIG. 1, FIG. 2 and FIG. 3, the leak-proof straw cup comprises a receiving portion 1 for receiving liquid, and an opening is formed in one end of the receiving portion 1 to allow liquid to flow in or out of the receiving portion 1; a sealing portion 2 is detachably connected to an inner wall of the receiving portion 1 and used for sealing the opening of the receiving portion 1, thus making the receiving portion 1 leak-proof; in this embodiment, the receiving portion 1 and the sealing portion 2 are threadedly connected; a sealing ring 35 is fixed to a side wall of the sealing portion 2 in a clamped manner, and the sealing ring 35 is made from rubber, silica gel or other materials and used for improving the leak-proofness between the sealing portion 2 and the receiving portion 1; a circulation hole 3 is coaxially formed in the sealing portion 2 and penetrates through the sealing portion 2 in a thickness direction of the sealing portion 2, and two ends of the sealing portion 2 are connected by means of the circulation hole 3, that is, the inside and outside of the receiving portion 1 are connected by means of the circulation hole 3; a first water outlet portion 4 is detachably connected to the sealing portion 2, the first water outlet portion 4 is arranged in the receiving portion 1 and used for transferring liquid, and the first water outlet portion 4 is tubular and penetrates into the circulation hole 3, such that the water outlet portion 4 is connected to the circulation hole 3; a storage portion 5 is fixed to a side wall of the receiving portion 1, and in this embodiment, the storage portion 5 is a cup handle; and the storage portion 5 is used for storing the first water outlet portion 4. When not used, the first water outlet portion 4 can be detached and placed in the storage portion 5, thus facilitating the storage of the first water outlet portion 4.

Referring to FIG. 1, FIG. 2 and FIG. 3, the storage portion 5 is curved, and in this embodiment, the storage portion 5 is C-shaped; two ends of the storage portion 5 are fixed to the side wall of the receiving portion 1 by bonding or integrated molding, such that a gap is formed between an inner side wall of the storage portion 5 and an outer side wall of the receiving portion 1 to allow users to hold the storage portion 5 with their hands to change the position of the receiving portion 1; a storage groove 6 is formed in the storage portion 5 and used for receiving the first water outlet portion 4; an anti-disengagement portion 7 is arranged on the storage portion 5 and used for sealing the storage groove 6 to prevent the first water outlet portion 4 from disengaging from the storage groove 6; one end of the anti-disengagement portion 7 is rotatably connected to the storage portion 5 by means of a rotating shaft, and in this embodiment, the rotating shaft is arranged on an inner side wall of the storage groove 6; the other end of the anti-disengagement portion 7 is arranged at an end of the storage groove 6 and seals the storage groove 6; a second magnet 9 is fixed to a side wall of an end, away from the rotating shaft, of the anti-disengagement portion 7 in an inlaid manner, a first magnet 8 is fixed in the storage portion 5, and the first magnet 8 and the second magnet 9 are attracted manually to fix the position of the anti-disengagement portion 7 and the position of the storage portion 5; a gap is formed between a top end of the anti-disengagement portion 7 and an inner side wall of the storage groove 6, such that the anti-disengagement portion 7 can be controlled to move to separate the first magnet 8 from the second magnet 9 to allow the first water outlet portion 4 to be taken out.

Referring to FIG. 1, FIG. 2 and FIG. 3, a connecting portion 10 is fixed to the bottom of the sealing portion 2 by integrated molding, the connecting portion 10 is hollow, connected to the circulation hole 3 and coaxial with the sealing portion 2, the first water outlet portion 4 penetrates into the connecting portion 10, a second water outlet portion 12 is detachably connected to the bottom of the connecting portion 10, and the second water outlet portion 12 extends to the bottom of the inner side of the receiving portion 1 and is tubular, such that when the first water outlet portion 4 is connected to the sealing portion 2, the first water outlet portion 4 and the second water outlet portion 12 are connected to allow users to drink water.

Referring to FIG. 1, FIG. 2 and FIG. 3, a positioning portion 13 is detachably connected to the bottom of the connecting portion 10, the positioning portion 13 is hollow and penetrates into the connecting portion 10, a positioning ring 14 is fixed to an outer side wall of the positioning portion 13 by integrated molding, and an end face of the positioning ring 14 abuts against an end of the connecting portion 10 to limit the positioning portion 13; the second water outlet portion 12 penetrates into the positioning portion 13; and the positioning portion 13 is made from silica gel, rubber or other materials. Because the positioning portion 13 is elastic, the positioning portion 13 is in interference fit with the connecting portion 10 after being mounted, and the second water outlet portion 12 is in interference fit with the positioning portion 13. In this way, both assembly and disassembly are easy.

Figure 4:
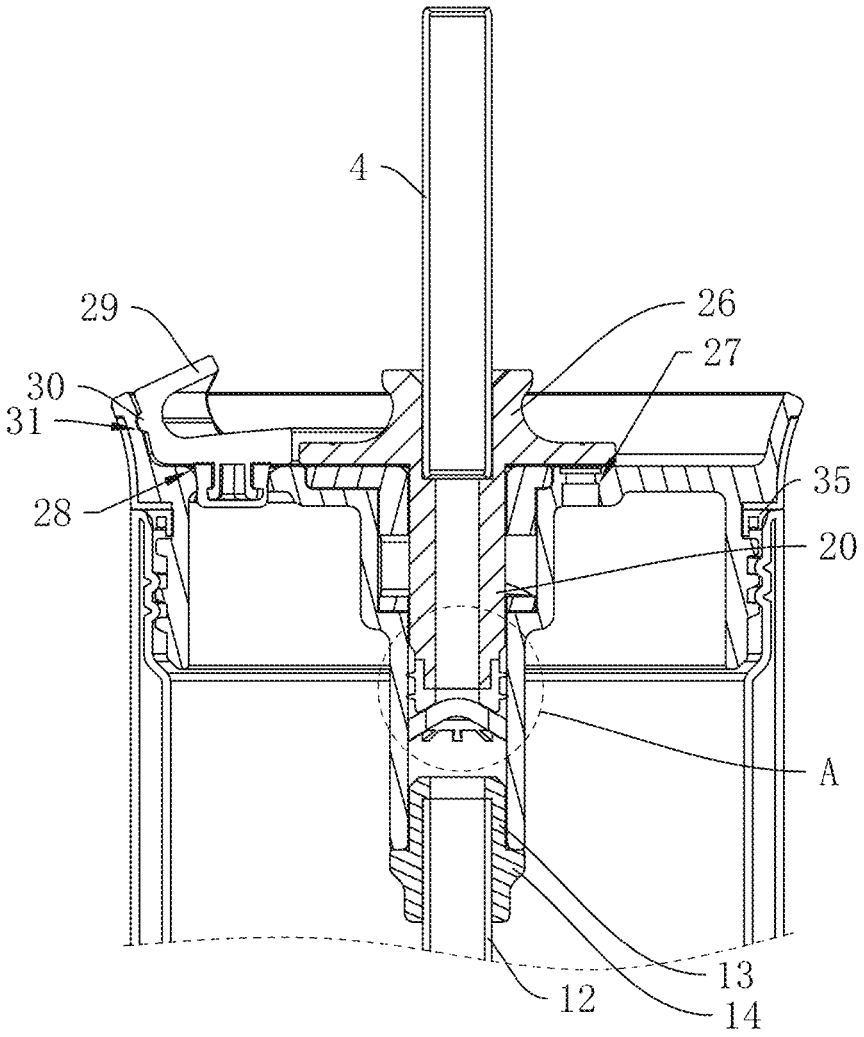
FIG. 4 is a sectional view of the connection of a sealing cover according to Embodiment 1 of the application.
Figure 5:
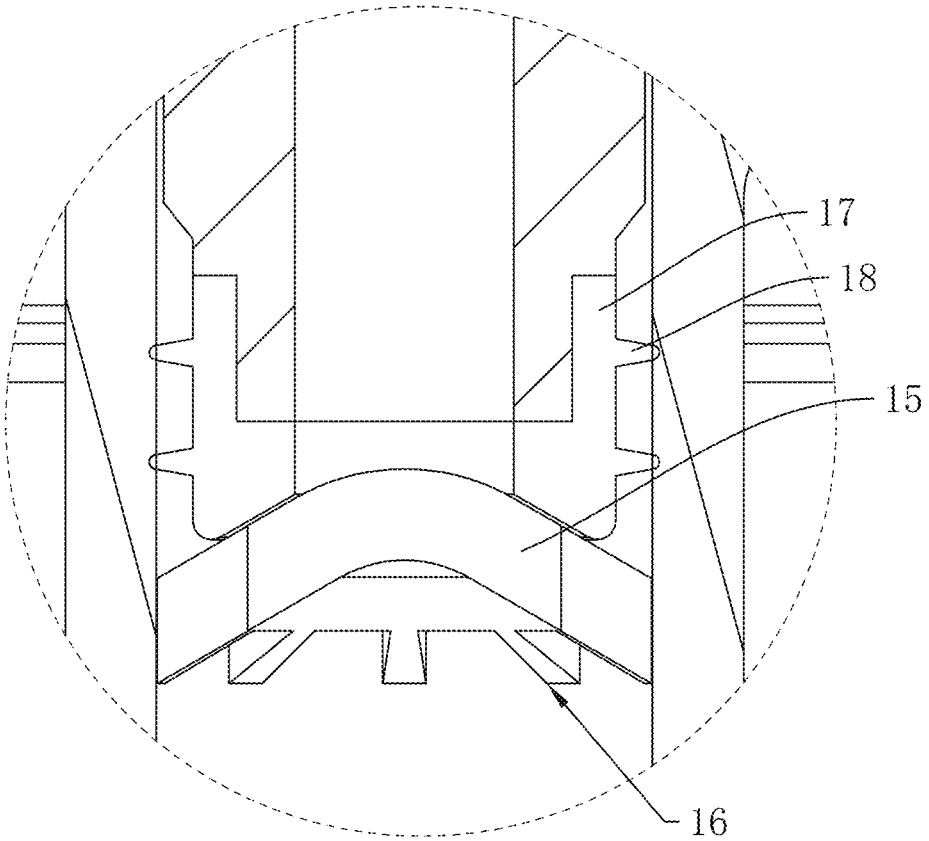
FIG. 5 is an enlarged view of part A in FIG. 4.

Referring to FIG. 3, FIG. 4 and FIG. 5, a blocking portion 15 is formed on an inner side wall of the connecting portion 10 by integrated molding and has an end face protruding towards the sealing portion 2, a plurality of water holes 16 are formed in the blocking portion 15 and uniformly distributed around the axis of the blocking portion 15, one side wall of each of the water holes 16 is attached to the inner side wall of the connecting portion 10, a first sealing portion 17 is slidably arranged in the connecting portion 10 and used for sealing the water holes 16 to prevent liquid in the receiving portion 1 from being transferred out of the receiving portion 1; and second sealing portions 18 are formed in an outer side wall of the first sealing portion 17 by integrated molding, the second sealing portions 18 are circular, and a side wall of each of the second sealing portions 18 abuts against an inner wall of the connecting portion 10, such that the sealing performance of the first sealing portion 17 is improved. The first sealing portion 17 can be controlled to move in the connecting portion 10 to control the water holes 16 to be opened or closed.

Referring to FIG. 2, FIG. 3 and FIG. 4, a control portion 19 is fixed to the sealing portion 2 in a bonded or clamped manner and partially extends into the circulation hole 3, the control portion 19 is hollow, a driving portion 20 is arranged in the control portion 19, and the first sealing portion 17 is circular and disposed around an end of the driving portion 20. By controlling the position of the driving portion 20, the position of the first sealing portion 17 can be controlled to control the water holes 16 to be opened or closed; in addition, the driving portion 20 is hollow, the first water outlet portion 4 penetrates into the driving portion 20 and is connected to the second water outlet portion 12, such that users can drink water smoothly.

Referring to FIG. 2, FIG. 3 and FIG. 4, stop blocks 21 are fixed to a side wall of the driving portion 20 by integrated molding, and in this embodiment, two stop blocks 21 are fixed to the side wall of the driving portion 20; stop grooves 22 are formed in a side wall of the control portion 19 and allow the stop blocks 21 to penetrate therein; and each stop groove 22 comprises a first horizontal portion, an oblique portion and a second horizontal portion, and the first horizontal portion is lower than the second horizontal portion. The driving portion 20 can be rotated to drive the stop blocks 21 to move in the stop grooves 22 to adjust the position of the first sealing portion 17 so as to control the water holes 16 to be opened or closed. When the stop blocks 21 move from the first horizontal portions to the second horizontal portions, the first sealing portion 17 moves away from the blocking portion 15 under the action of the driving portion 20, and at this moment, the water holes 16 are opened. When the stop blocks 21 move from the second horizontal portions to the first horizontal portions, the first sealing portion 17 moves close to the blocking portion 15 under the action of the driving portion 20, and at this moment, the water holes 16 are closed.

Referring to FIG. 2, FIG. 3 and FIG. 4, mounting grooves 23 are formed in the control portion 19, a length direction of the mounting grooves 23 is perpendicular to a length direction of the second horizontal portions, the mounting grooves 23 extend to the top of the control portion 19 and are connected to the outside of the control portion 19, and the mounting grooves 23 also extend to the second horizontal portions, that is, the mounting grooves 23 are connected to the limit grooves 22. Stop protrusions 25 are fixed to inner side walls of the stop grooves 22 by bonding or integrated molding, and the stop protrusions 25 are elastic and used for preventing the stop blocks 21 from moving. In use, the driving portion 20 is rotated to drive the stop blocks 21 to move from the first horizontal portions to the second horizontal portions and is then further rotated to drive the stop blocks 21 to move in the horizontal direction to come in contact with the stop protrusions 25, and the driving portion 20 is further controlled to move until the stop blocks 21 press against the stop protrusions 25 and move to the other sides of the stop protrusions 25. In this embodiment, the mounting grooves 23 are formed in sides, close to the oblique portions, of the stop protrusions 25. When the stop blocks 21 are located on sides, away from the oblique portions, of the stop protrusions 25, the positions of the stop blocks 21 are fixed in absence of an external force, such that water can flow out smoothly. When needing to be taken out, the driving portion 20 is rotated reversely to align the stop blocks 21 with the mounting grooves 23, and then the driving portion 20 can be taken out.

Referring to FIG. 2, FIG. 3 and FIG. 4, a control button 26 is fixed to the top of the driving portion 20 by integrated molding. The control button 26 can be controlled to rotate to drive the driving portion 20 to rotate, such that the driving portion 20 can be controlled to rotate more easily. An opening is formed in the middle of the control button 26 and connected to the inside of the driving portion 20, the first water outlet portion 4 penetrates into the opening in the middle of the control button 26 and is in interference fit with an inner side wall of the opening in the middle of the control button 26, thus ensuring that a straw can be inserted into the cup body stably. An air hole 27 is formed in the sealing portion 2 and penetrates through the sealing portion 2 in a thickness direction of the sealing portion 2. In the drinking process, the air hole 27 can facilitate air circulation in the receiving portion 1 to allow users drink water smoothly. The air hole 27 is formed in the bottom of the control button 26, such that the possibility of liquid leaking caused by the air hole 27 is reduced. The opening of the control button 26 is provided with a mounting guide surface 34 to facilitate the installation of the straw.

Referring to FIG. 1 and FIG. 4, a second drinking hole 28 is formed in the sealing portion 2, a sealing cover 29 is rotatably arranged on the sealing portion 2 and used for sealing the second drinking hole 28, a sealing block is fixed to an end of the sealing cover 29 by integrated molding, and during the rotation process of the sealing cover 29, the sealing block penetrates into the second drinking hole 28 to seal the second drinking hole 28. A sealing groove is formed in the sealing cover 29 and is identical in shape with an edge of the control button 26, such that the sealing groove will not come in contact with the control button 26 during the rotation process of the sealing cover 29. A positioning rib 30 is fixed to an end of the sealing cover 29 by integrated molding, and a positioning groove 31 is formed in the sealing portion 2 and allows the positioning rib 30 to penetrate therein. When the positioning rib 30 penetrates into the positioning groove 31, the position of the sealing cover 29 is fixed, thus reducing the possibility of opening the sealing cover 29 in absence of an external force. A limiting block 32 is fixed to the sealing portion 2 by integrated molding and used for limiting the sealing cover 29, and during the rotation process of the sealing cover 29, the limiting block 32 abuts against an end face of the sealing cover 29 to prevent the sealing cover 29 against further rotation. A positioning block 33 is fixed to a rotating shaft of the sealing cover 29 by integrated molding and used for limiting the position of the sealing cover 29. When the end face of the sealing cover 29 abuts against the limiting block 32, the positioning block 33 abuts against the end face of the sealing portion 2, thus limiting the sealing cover 29.

Embodiment 2

Figure 6:
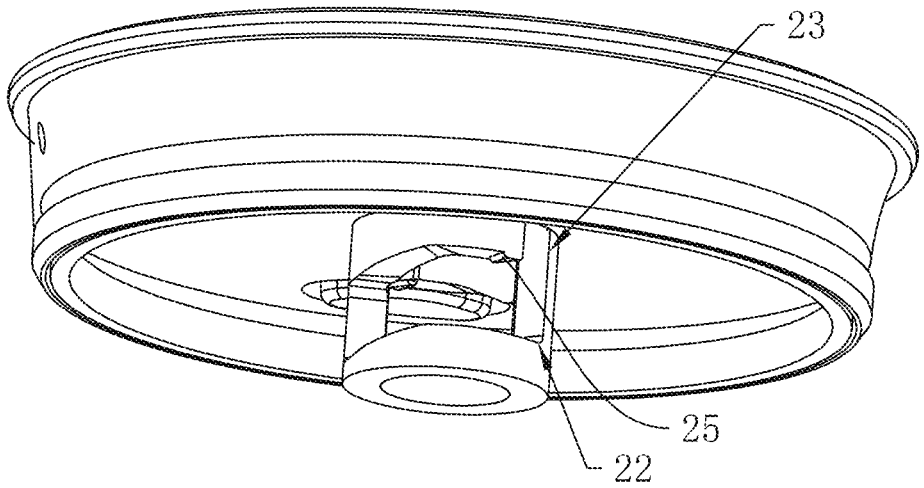
FIG. 6 is a schematic diagram of the position of a mounting groove according to Embodiment 2 of the application.

Embodiment 2 of the application is different from Embodiment 1 in the following aspects: referring to FIG. 6, in this embodiment, the mounting grooves 23 are formed in sides, away from the oblique portions, of the stop protrusions 25; in use, the driving portion 20 is rotated to drive the stop blocks 21 to move from the first horizontal portions to the second horizontal portions and is then further rotated 20 to drive the stop blocks 21 to move upwards in the horizontal direction and come in contact with the stop protrusions 25, and at this moment, the water holes 16 are opened, and users can drink water; when needing to be removed, the driving portion 20 is further controlled to move until the stop blocks 21 press against the stop protrusions 25 and move to the other sides of the stop protrusions 25, at this moment, the stop blocks 21 correspond to the mounting grooves 23 in positions, and the driving portion 20 can be taken out. The operation process is simple.

The implementation principle of the leak-proof straw cup provided by the embodiments of the invention is as follows: the sealing portion 2 and the receiving portion 1 are assembled together, the anti-disengagement portion 7 on the side wall of the storage portion 5 is opened, the first water outlet portion 4 in the storage groove 6 is taken out, the control button 26 is rotated to drive the stop blocks 21 to move in the stop grooves 22, at this moment, the water holes 16 are opened, the first water outlet portion 4 penetrates into the opening in the middle of the control button 26, and users can drink water smoothly; and after drinking, the first water outlet portion 4 is placed in the storage groove 6, and the control button 26 is reversely rotated to seal the water holes 16.

The above embodiments are all preferred ones of the invention and are not intended to limit the protection scope of the application. Therefore, all equivalent transformations made according to the structure, shape and principle of the application should fall within the protection scope of the application.

What is claimed is:

1. A leak-proof straw cup, comprising:

a receiving portion (1) for receiving liquid;

a first water outlet portion (4) arranged in the receiving portion (1) and used for transferring the liquid; and a storage portion (5) fixed to a side wall of the receiving portion (1) and used for storing the first water outlet portion (4);

wherein, the leak-proof straw cup further comprises a sealing portion (2) detachably connected to the receiving portion (1) and used for sealing the receiving portion (1); and a circulation hole (3) formed in the sealing portion (2) and connecting two sides of the sealing portion (2);

wherein, a connecting portion (10) is fixed to a bottom of the sealing portion (2) and connected to the circulation hole (3), and the first water outlet portion (4) penetrates through the connecting portion (10);

a blocking portion (15) is fixed in the connecting portion (10) and has an end face protruding towards the sealing portion (2), a plurality of water holes (16) are formed in the blocking portion (15), and a first sealing portion (17) for sealing the water holes (16) is slidably arranged in the connecting portion (10);

a control portion (19) is fixed to the sealing portion (2) and partially extends into the circulation hole (3), the control portion (19) is hollow, a driving portion (20) is arranged in the control portion (19), the first sealing portion (17) is circular and disposed around an end of the driving portion (20), and the first water outlet portion (4) penetrates into the driving portion (20) and is connected to a second water outlet portion (12).

2. The leak-proof straw cup according to claim 1, wherein the storage portion (5) is curved, and a gap is formed between a side wall of the storage portion (5) and an outer side wall of the receiving portion (1).

3. The leak-proof straw cup according to claim 2, wherein a storage groove (6) is formed in the storage portion (5) and used for receiving the first water outlet portion (4), an anti-disengagement portion (7) is arranged on the storage portion (5), one end of the anti-disengagement portion (7) is rotatably arranged on the storage portion (5), and the other end of the anti-disengagement portion (7) is arranged at an end of the storage groove (6) and seals the storage groove (6).

4. The leak-proof straw cup according to claim 3, wherein a first magnet (8) is fixed in the storage portion (5), a second magnet (9) is fixed in the anti-disengagement portion (7), and the first magnet (8) and the second magnet (9) are mutually attracted to fix positions of the anti-disengagement portion (7) and the storage portion (5).

5. The leak-proof straw cup according to claim 1, wherein a second water outlet portion (12) is detachably connected to a bottom of the connecting portion (10) and extends to a bottom of an inner side of the receiving portion (1).

6. The leak-proof straw cup according to claim 5, wherein a positioning portion (13) is detachably connected to the bottom of the connecting portion (10) and penetrates into the connecting portion (10), a positioning ring (14) is fixed to an outer wall of the positioning portion (13) and abuts against an end of the connecting portion (10), and the second water outlet portion (12) penetrates through the positioning portion (13) and is connected to an inside of the connecting portion (10).

7. The leak-proof straw cup according to claim 1, wherein a plurality of second sealing portions (18) are fixed to an outer wall of the first sealing portion (17) and abut against an inner wall of the connecting portion (10).

8. The leak-proof straw cup according to claim 1, wherein a stop block (21) is fixed to a side wall of the driving portion (20), a stop groove (22) allowing the stop block (21) to penetrate therein is formed in a side wall of the control portion (19), the stop groove (22) is oblique, and the driving portion (20) is rotatable to drive the stop block (21) to move in the stop groove (22) to adjust a position of the first sealing portion (17) to control the water holes (16) to be opened or closed.

9. The leak-proof straw cup according to claim 8, wherein a mounting groove (23) is formed in the control portion (19) and extends to a top of the control portion (19), the mounting groove (23) is connected to the stop groove (22), and a stop protrusion (25) is fixed to an inner side wall of the stop groove (22) and used for preventing the stop block (21) from moving into the mounting groove (23).

10. The leak-proof straw cup according to claim 1, wherein an air hole (27) is formed in the sealing portion (2).

11. The leak-proof straw cup according to claim 1, wherein a second drinking hole (28) is formed in the sealing portion (2), and a sealing cover (29) for sealing the second drinking hole (28) is rotatably arranged on the sealing portion (2).

12. The leak-proof straw cup according to claim 11, wherein a positioning rib (30) is fixed to the sealing cover (29), and a positioning groove (31) allowing the positioning rib (30) to penetrate therein is formed in the sealing portion (2).

13. The leak-proof straw cup according to claim 11, wherein a limiting block (32) is fixed to the sealing portion (2), and a positioning block (33) is fixed to a rotating shaft of the sealing cover (29).

14. The leak-proof straw cup according to claim 1, wherein a sealing ring (35) is fixed to a side wall of the sealing portion (2) and used for improving leak-proofness between the sealing portion (2) and the receiving portion (1).

15. The leak-proof straw cup according to claim 1, wherein the storage portion (5) is a cup handle.

* * * * *